US007692677B2

(12) United States Patent
Yamade

(10) Patent No.: US 7,692,677 B2
(45) Date of Patent: Apr. 6, 2010

(54) THERMAL PRINT HEAD

(75) Inventor: Takumi Yamade, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 150 days.

(21) Appl. No.: 11/922,182

(22) PCT Filed: Jun. 13, 2006

(86) PCT No.: PCT/JP2006/311850

§ 371 (c)(1),
(2), (4) Date: Dec. 13, 2007

(87) PCT Pub. No.: WO2006/134927

PCT Pub. Date: Dec. 21, 2006

(65) Prior Publication Data

US 2009/0115830 A1 May 7, 2009

(30) Foreign Application Priority Data

Jun. 13, 2005 (JP) ..... 2005-172403

(51) Int. Cl.
*B41J 2/335* (2006.01)

(52) U.S. Cl. ..... 347/208

(58) Field of Classification Search ..... 347/208, 347/202

See application file for complete search history.

(56) References Cited

U.S. PATENT DOCUMENTS

| | | | | |
|---|---|---|---|---|
| 5,272,489 | A * | 12/1993 | Kobayashi et al. | 347/206 |
| 5,594,488 | A * | 1/1997 | Tsushima et al. | 347/208 |
| 5,635,975 | A * | 6/1997 | Shirakawa et al. | 347/208 |
| 5,661,513 | A * | 8/1997 | Shirakawa et al. | 347/202 |
| 5,940,110 | A * | 8/1999 | Nakamura et al. | 347/208 |
| 6,501,497 | B2 * | 12/2002 | Shirakawa et al. | 347/208 |

FOREIGN PATENT DOCUMENTS

| | | |
|---|---|---|
| JP | 11-91149 | 4/1999 |
| JP | 2001-38934 | 2/2001 |
| JP | 2001-105641 | 4/2001 |

OTHER PUBLICATIONS

International Search Report from the corresponding PCT/JP2006/311850, mailed Aug. 15, 2006.

* cited by examiner

*Primary Examiner*—Huan H Tran
(74) *Attorney, Agent, or Firm*—Hamre, Schumann, Mueller & Larson, P.C.

(57) ABSTRACT

A thermal printhead (A) includes an insulating substrate (1), a glaze layer (2), a resistor layer (3), an electrode layer (4) and a protective layer (5). The electrode layer (4) has a two-layer structure made up of a lower first electrode layer (4*a*) and an upper second electrode layer (4*b*). The resistor layer (3) includes a heating portion (7). The heating portion (7) is exposed from both the first electrode layer (4*a*) and the second electrode layer (4*b*) and is positioned on a bulging portion (2*c*) of the glaze layer (2).

4 Claims, 2 Drawing Sheets

THERMAL PRINT HEAD

TECHNICAL FIELD

The present invention relates to a thermal printhead used for thermosensitive recording or thermal transfer recording. The present invention particularly relates to a thin-film thermal printhead used for a barcode printer or a dye sublimation photo color printer.

BACKGROUND ART

FIG. 3 shows a conventional thin-film thermal printhead disclosed in the Patent Document 1 described below. The thermal printhead B includes an insulting substrate 101, a heat-retaining glaze layer 102, a resistor layer 103 in the form of a thin film, an electrode layer 104 in the form of a thin film, and a protective layer 105. The heat-retaining glaze layer 102 is formed on the insulating substrate 101 and includes a bulging portion 102*c*. The resistor layer 103 is formed as a thin film on the heat-retaining glaze layer 102 by sputtering and covers the bulging portion 102*c*. The electrode layer 104 is formed as a thin film on the resistor layer 103 by sputtering and divided by an electrode layer gap 104*c* positioned on the top of the bulging portion 102*c*. The protective layer 105 covers both of the resistor layer 103 and the electrode layer 104. Due to the presence of the electrode layer gap 104*c*, the resistor layer 103 includes a portion which is not covered by the electrode layer 104, i.e., a heating portion 107. With this arrangement, when current flows through the electrode layer 104, Joule heat is generated at the heating portion 107. The thermosensitive recording or thermal transfer recording is performed by utilizing this heat.

The electrode layer 104 comprises a single layer having a uniform thickness of at least 0.5 μm and generally about 0.8 μm. The electrode layer 104 includes an electrode pad having a predetermined thickness so that a metal wire is reliably bonded to the electrode pad in wire bonding.

However, to secure a sufficient thickness of the electrode layer 104 causes the following drawbacks.

Firstly, a stepped portion 104*d* having a height of at least 0.5 μm which corresponds to the thickness of the electrode layer is formed at the end of the electrode layer 104 which adjoins the heating portion 107. Due to the stepped portion 104*d*, a stepped portion 105*d* is formed at the protective layer 105 laminated on the electrode layer. The stepped portion 105*d* hinders the close contact between the thermal printhead B and a recording medium, and hence, hinders proper utilization of the heat generated by the heating portion 107 for printing. Further, when foreign matter enters the space between the thermal printhead B and the recording medium, the foreign matter may be caught in the stepped portion 105*d*. In such a case, the protective layer may be damaged or peeled off.

Secondly, the heat generated at the heating portion 107 is likely to escape through the thick electrode layer 104. Thus, the heat generated by the heating portion 107 is not utilized effectively.

Thirdly, as shown in FIG. 4, when the thickness of the electrode layer 104 exceeds 0.5 μM, small projections 108 called hillocks are formed on the surface of the electrode layer 104 due to the growth of Al crystal. Due to the hillocks 108, small projections 109 are formed on the surface of the electrode layer 104. The projections 109 increase the coefficient of friction between the protective layer 105 and the printing medium, and hence, cause meandering or clogging of the printing medium. Further, due to the contact of the recording medium with the projections 109, an excessively large external force is applied to the projections 109. As a result, the projections 109 or the protective layer 105 may be broken. In such a case, ions such as $Cl^-$ or $Na^+$ enter through the broken portion, so that the electrode layer 104 is corroded.

Patent Document 1: JP-A-2001-105641

DISCLOSURE OF THE INVENTION

An object of the present invention, which is proposed under the circumstances described above, is to provide a thermal printhead capable of effectively utilizing the generated heat and providing good printing quality.

A thermal printhead according to the present invention comprises an insulating substrate, a glaze layer formed on the insulating substrate, a resistor layer formed on the glaze layer, an electrode layer formed on the resistor layer, where part of the resistor layer is exposed to serve as a heating portion, and a protective layer covering the electrode layer and the heating portion. The electrode layer is mainly composed of Al and comprises a lower first electrode layer and an upper second electrode layer to partially cover the first electrode layer. The first electrode layer is spaced apart from the heating portion by a predetermined distance. The second electrode layer includes an extension which extends beyond the first electrode layer and adjoins the heating portion. The first electrode layer has a thickness in the range of 0.5 to 2.0 μm, whereas the second electrode layer has a thickness in the range of 0.2 to 0.4 μm.

In this structure, the thickness of the second electrode layer (extension) adjoining the heating portion is in the range of 0.2 to 0.4 μm, which is smaller than the thickness of the above-described conventional electrode layer. Accordingly, the stepped portion (see the reference sign 5*d* in FIG. 2) of the protective layer formed on the second electrode layer is smaller than that of the conventional structure. As a result, a printing medium properly comes into close contact with the thermal printhead, so that the thermal efficiency in the printing is enhanced. Further, since the stepped portion is small, the possibility that foreign matter is caught between the thermal printhead and the recording medium is small. Moreover, since the thickness of the second electrode layer is small, the formation of hillocks at the electrode layer is suppressed, and heat generated by the heating portion is prevented from escaping to the outside through the electrode layer.

Preferably, the resistor layer has a thickness in the range of 500 to 1000 Å, whereas the protective layer has a thickness in the range of 5 to 10 μm.

Preferably, the glaze layer includes a bulging portion upon which the heating portion is provided.

Preferably, the extension of the second electrode layer partially extends over the bulging portion, whereas the first electrode layer is spaced apart from the bulging portion.

Preferably, the first electrode layer includes a tapered end facing the bulging portion, and the tapered end has a length in the range of 1 to 10 μm.

Preferably, the thermal printhead of the present invention further comprises an insulating layer covering the protective layer at a region corresponding to the two-layer structure made up of the first electrode layer and the second electrode layer.

Other features and advantages of the present invention will become more apparent from detailed description given below with reference to the accompanying drawings.

BEST MODE FOR CARRYING OUT THE INVENTION

Preferred embodiments of the present invention will be described below with reference to the accompanying drawings.

Figure 1:
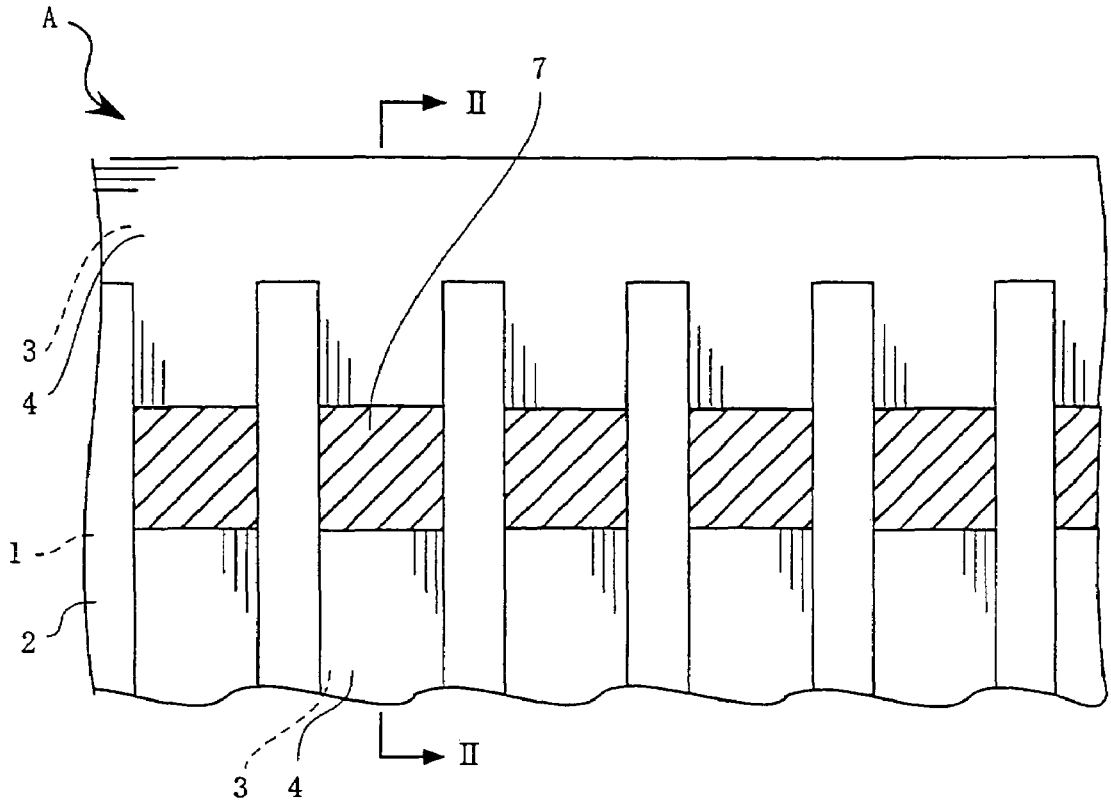
FIG. 1 is a plan view showing a part of a thermal printhead according to a first embodiment of the present invention.

FIG. 1 is a plan view showing a part of a thermal printhead A according to a first embodiment of the present invention. The illustration of a protective layer and an insulting layer, which will be described later, are omitted in FIG. 1.

Figure 2:
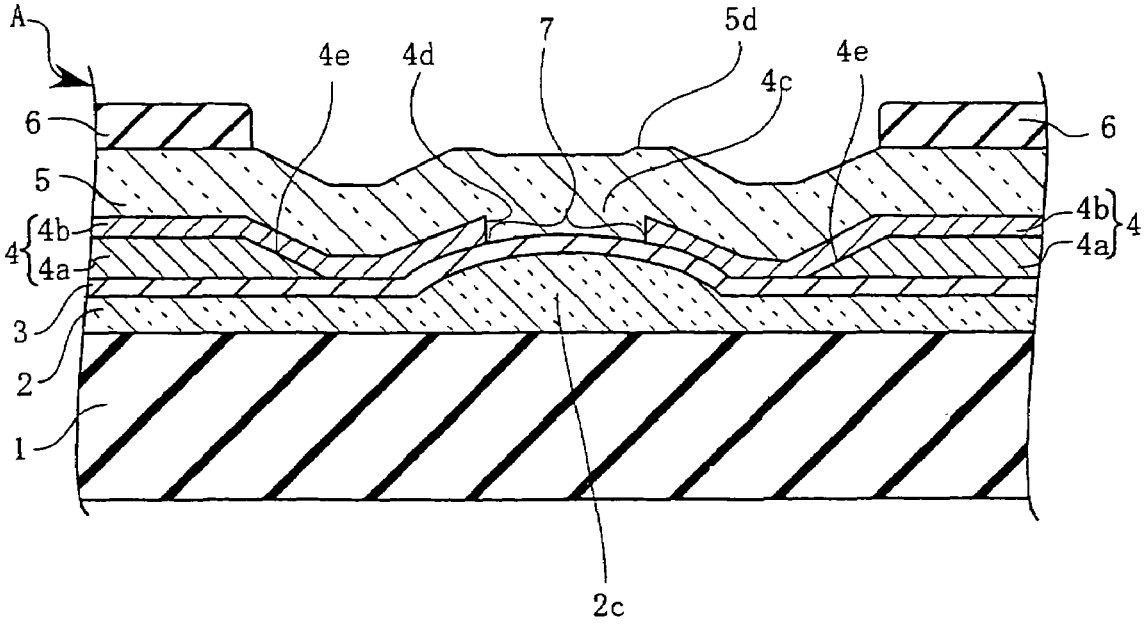
FIG. 2 is a sectional view taken along lines II-II in FIG. 1.
Figure 3:
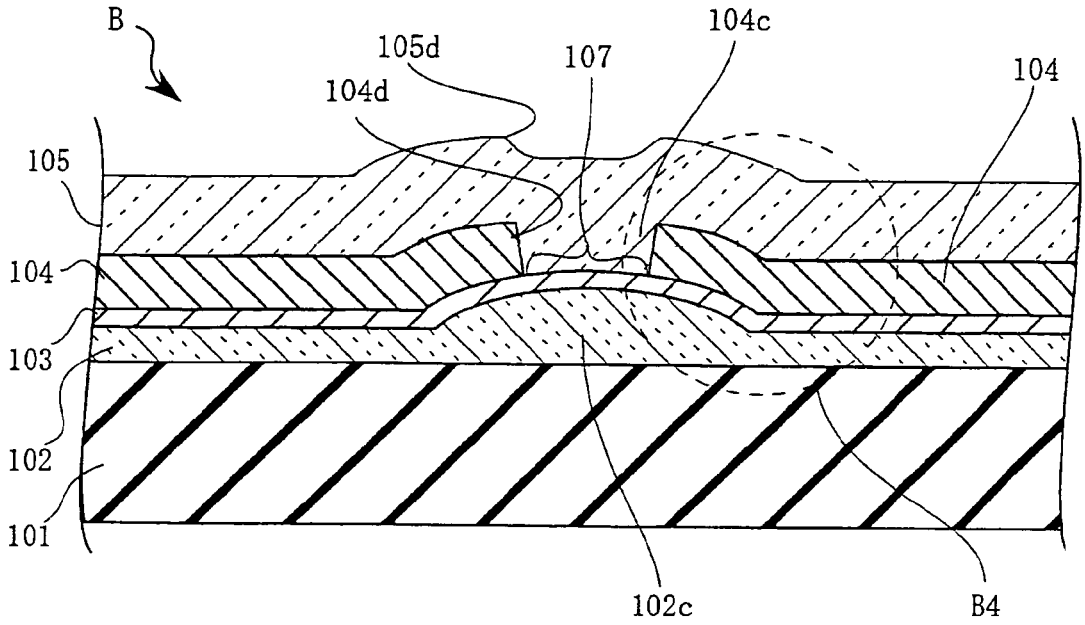
FIG. 3 is a sectional view showing a conventional thermal printhead.
Figure 4:
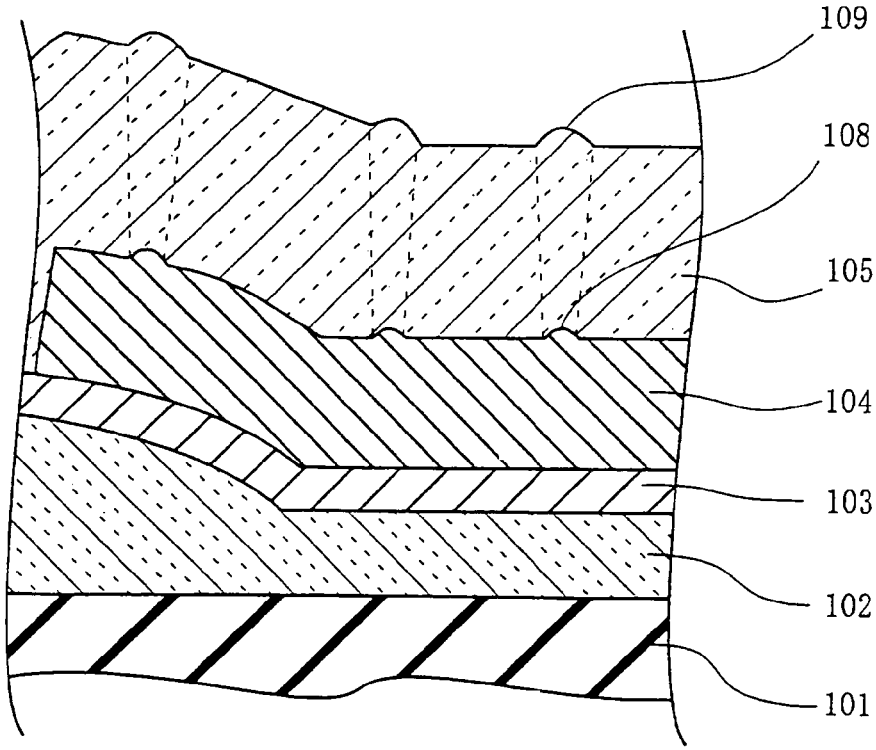
FIG. 4 is an enlarged view of the portion B4 in FIG. 3.

FIG. 2 is a sectional view taken along lines II-II in FIG. 1. It is to be noted that the thickness is exaggerated in FIG. 2. The thermal printhead A includes a substrate 1, a heat-retaining glaze layer 2, a resistor layer 3, an electrode layer 4, a protective layer 5 and an insulating layer 6.

The substrate 1 is made of an insulating material such as an alumina ceramic material. The heat-retaining glaze layer 2 is formed on the substrate 1 by e.g. thick film printing and mainly composed of glass. The heat-retaining glaze layer 2 includes a gently bulging portion 2*c*. The bulging portion 2*c* extends continuously in the longitudinal direction of the substrate 1, which corresponds to the horizontal direction in FIG. 1.

The resistor layer 3 is formed on the heat-retaining glaze layer 2 by sputtering. The resistor layer 3 may be mainly composed of $TaSiO_2$. The resistor layer 3 has a thickness of 500 to 1000 Å and traverses the bulging portion 2*c*.

The electrode layer 4 is formed on the resistor layer 3. The electrode layer 4 has a two-layer structure made up of a first electrode layer 4*a* on the lower side in the figure and a second electrode layer 4*b* on the upper side.

The protective layer 5 is formed by sputtering to cover the resistor layer 3 and the electrode layer 4. The thickness of the protective layer 5 may be 5 to 10 μm, and preferably, 6 to 8 μm. The protective layer 5 may be made of a material mainly composed of $SiO_2$. Although the protective layer 5 comprises a single layer, the present invention is not limited to this, and a protective layer having a multi-layer structure may be employed.

As shown in FIG. 2, the insulating layer 6 is formed by printing on the protective layer 5 at a region at which the first electrode layer 4*a* and the second electrode layer 4*b* overlap each other.

The resistor layer 3 and the electrode layer 4 will be described further in detail. As will be understood from FIG. 1, a combination of the resistor layer 3 and the electrode layer 4 laminated on the resistor layer comprise a plurality of laminated strips. The laminated strips are arranged in the longitudinal direction of the substrate 1, which corresponds to the horizontal direction in FIG. 1 (the primary scanning direction). Each of the laminated strips traverses the bulging portion 2*c* and includes a heating portion on the bulging portion 2*c*. The laminated strips are formed by performing photo-etching in each of the process steps of forming the resistor layer 3, the first electrode layer 4*a* and the second electrode layer 4*b*. The tapered portions 4*e*, which will be described later, are formed by the photo-etching in the process step of forming the first electrode layer 4*a*.

The first electrode layer 4*a* is formed by sputtering using a material mainly composed of a conductive substance such as Al. The first electrode layer 4*a* has a thickness of 0.5 to 2.0 μm and is divided at a region including the bulging portion 2*c* and the adjacent portion. At the ends of the first electrode layer 4*a* which adjoin this region, tapered portions 4*e* having a predetermined length (dimension in the horizontal direction in FIG. 2) are provided. The length of the tapered portions 4*e* may be in the range of 1 to 10 μm and about 3 μm in the illustrated example. The tapered portions 4*e* face the bulging portion 2*c* while being spaced from the bulging portion by a predetermined distance. The provision of the tapered portions 4*e* prevents a stepped portion from being formed at the second electrode layer 4*b*, which will be described later. Thus, the first electrode layer 4*a* and the second electrode layer 4*b* firmly adhere to each other, and hence, the electrical conduction between the first and the second electrode layers is ensured.

The second electrode layer 4*b* is also formed by sputtering using a material mainly composed of a conductive substance such as Al. The second electrode layer 4*b* includes a portion covering the first electrode layer 4*a* and a portion directly covering the resistor layer 3, i.e., an extension. As shown in FIG. 2, part of the extension extends over the bulging portion 2*c*. The second electrode layer 4*b* is divided by an electrode layer gap 4*c* provided on the top of the bulging portion 2*c*. At the electrode layer gap 4*c*, the resistor layer 3 is covered neither by the first electrode layer 4*a* nor the second electrode layer 4*b*. This portion is called a heating portion 7 and functions as a heating element.

The second electrode layer 4*b* has a thickness of 0.2 to 0.4 μm. When the thickness of the second electrode layer 4*b* is smaller than 0.2 μm, heat may be excessively concentrated on the heating portion 7 (and the adjacent portion), so that the resistor layer 3 may be broken. Thus, in the present invention, the minimum value of the thickness of the second electrode layer 4*b* is set to 0.2 μm.

The wiring and the printing operation of the thermal printhead A will be described with reference to FIG. 2. One of the right and the left ends of the electrode layer 4 as viewed in the figure includes non-illustrated electrode pads. The electrode pads are connected to output terminals of non-illustrated driver ICs via wires. The other end of the electrode layer 4 is formed with a common electrode. The common electrode is connected to a power supply circuit. When the printer is operated for printing, the driver ICs cause current to flow through selected ones of the heating portions 7 in accordance with given print data. Accordingly, the selected heating portions 7 generate Joule heat, and this heat is transferred to the recording medium via the protective layer 5, whereby the desired printing is performed.

In manufacturing the thermal printhead A in accordance with the above-described process, it is possible to prevent undesirable projections from forming at a portion of the printhead that faces the recording medium. Specific advantages are as follows. First, since the stepped portion 4*d* of the electrode layer 4 is low, a stepped portion 5*d* of the protective layer 5, which is formed due to the presence of the stepped portion 4*d*, is kept small. Secondly, no hillocks are formed at a region where only the second electrode layer 4*b* is provided, since the second electrode layer 4*b* is appropriately thin. The absence of hillocks results in the absence of small projections which would otherwise be formed at the surface of the protective layer 5. Thirdly, the insulating layer 6 prevents hillocks from giving adverse effects. Ata region where the first electrode layer 4*a* and the second electrode layer 4*b* overlap each other, the formation of hillocks cannot be avoided due to the relatively large thickness of the second electrode layer 4*a*. However, the insulating layer 5 can hide the projections formed at the surface of the protective layer 5 on that region.

According to the present invention, the second electrode layer 4*b* adjoining the heating portion 7 has a small thickness of about 0.2 to 0.4 μm. In this arrangement, outward heat transfer along the electrode layer 4 decreases, whereby the thermal efficiency of the thermal printhead A becomes at least 1.5 times as large as that of the conventional structure. This means that the energy consumption in the thermal printhead A according to the present invention is advantageously small.

Further, according to the present invention, small projections are not formed at the surface of the protective layer 5, which prevents the clogging or meandering of the recording medium. An accelerated scratch test conducted by the inventor of the present invention showed that the present invention can reduce the number of broken dots down to one third or less of that by the conventional structure.

The invention claimed is:

1. A thermal printhead comprising:

an insulating substrate;

a glaze layer formed on the insulating substrate;

a resistor layer formed on the glaze layer;

an electrode formed on the resistor layer, part of the resistor layer being exposed to serve as a heating portion; and a protective layer covering the electrode and the heating portion;

wherein the electrode is mainly composed of Al and comprises a lower first electrode layer and an upper second electrode layer covering part of the first electrode layer, the first electrode layer being spaced from the heating portion by a predetermined distance, the second electrode layer including an extension extending beyond the first electrode layer to adjoin the heating portion, the first electrode layer having a thickness in a range of 0.5 to 2.0 μm, the second electrode layer having a thickness in a range of 0.2 to 0.4 μm;

wherein the glaze layer includes a bulging portion, the heating portion being positioned on the bulging portion;

wherein the extension of the second electrode layer partially extends over the bulging portion, whereas the first electrode layer is spaced apart from the bulging portion; and wherein the first electrode layer includes a tapered end facing the bulging portion, the tapered end having a length in a range of 1 to 10 μm.

2. The thermal printhead according to claim 1, wherein the resistor layer has a thickness in a range of 500 to 1000 Å, whereas the protective layer has a thickness in a range of 5 to 10 μm.

3. The thermal printhead according to claim 1, further comprising an insulating layer covering the protective layer at a region corresponding to a two-layer structure made up of the first electrode layer and the second electrode layer.

4. A thermal printhead comprising:

an insulating substrate;

a glaze layer formed on the insulating substrate;

a resistor layer formed on the glaze layer;

an electrode formed on the resistor layer, part of the resistor layer being exposed to serve as a heating portion; and a protective layer covering the electrode and the heating portion;

where in the electrode is mainly composed of Al and comprises a lower first electrode layer and an upper second electrode layer covering part of the first electrode layer, the first electrode layer being spaced from the heating portion by a predetermined distance, the second electrode layer including an extension extending beyond the first electrode layer to adjoin the heating portion, the first electrode layer having a thickness in a range of 0.5 to 2.0 μm, the second electrode layer having a thickness in a range of 0.2 to 0.4 μm; and wherein the thermal printhead further comprises an insulating layer covering the protective layer at a region corresponding to a two-layer structure made up of the first electrode layer and the second electrode layer.

* * * * *